United States Patent [19]

Kapp et al.

[11] Patent Number: 4,773,101

[45] Date of Patent: Sep. 27, 1988

[54] BABY ROBE

[76] Inventors: Noreen L. A. Kapp; Ronald E. Kapp, both of P.O. #1178 Stn. "G", Calgary, Alberta, Canada, T3K 3G3

[21] Appl. No.: 919,359

[22] Filed: Oct. 16, 1986

[30] Foreign Application Priority Data

Oct. 17, 1985 [CA] Canada ..... 493159

[51] Int. Cl.[4] ..... A41D 11/00

[52] U.S. Cl. ..... 2/69.5; 2/80; 2/75

[58] Field of Search ..... 2/69.5, 69, 70, 75, 2/79, 80

[56] References Cited

U.S. PATENT DOCUMENTS

| | | | |
|---|---|---|---|
| 2,445,909 | 7/1948 | De Vries | 2/75 |
| 2,621,331 | 12/1952 | Loretto | 2/75 |
| 2,649,589 | 8/1953 | Shiltong | 2/75 |
| 2,675,554 | 4/1954 | Gertz | 2/80 |
| 2,777,130 | 1/1957 | Keller | 2/75 |
| 3,241,156 | 3/1966 | Birchwood | 2/75 |
| 3,812,539 | 5/1974 | Muehlberg et al. | 2/69.5 |
| 3,965,487 | 6/1976 | Mazur | 2/69.5 |

FOREIGN PATENT DOCUMENTS

| | | | |
|---|---|---|---|
| 952125 | 3/1964 | United Kingdom | 2/75 |

*Primary Examiner*—Louis K. Rimrodt
*Assistant Examiner*—J. L. Olds

[57] ABSTRACT

An article of clothing of adjustable length includes front and rear panels defining an open body portion with or without arms, a pair of legs; and a drawstring in each leg of the front and rear panels for varying the length of the legs. The top or bottom end of the drawstring is fixed in the panel, and the other end of the drawstring extends out of the panel, so that the string can be grasped. Relative movement between the drawstring and the legs results in lengthening or shortening of the garment.

14 Claims, 3 Drawing Sheets

BABY ROBE

BACKGROUND OF THE INVENTION

This invention relates to an article of clothing, and in particular to a child's article of clothing of adjustable size.

In general children's clothing is somewhat expensive, and is used for a short time only before the child grows out of the clothing. Accordingly, there exists a definite need for articles of clothing which are adjustable. Clothing of the type in question includes drawstrings. The use of drawstrings in clothing is not new, and is disclosed, for example by U.S. Pat. Nos. 2,420,344, which issued to V. C. Alexander on May 13, 1947 and 3,812,539, which issued to J. R. Muehlberg et al on May 28, 1974. While the patented articles are useful, they do not solve the problem of making children's clothing adjustable.

The object of the present invention is to solve the above-identified problem by providing an article of clothing which is relatively simple in terms of structure, and the length of which is readily adjustable.

BRIEF SUMMARY OF THE INVENTION

Accordingly, the present invention relates to an article of clothing comprising front panel means; rear panel means connected to said front panel means along the sides and bottom thereof to define a body portion with an open top end and a bottom leg portion; and drawstring means secured to at least one end of said leg portion and extending outwardly through at least one of said panel means, whereby pulling of the drawstring means while pushing the leg portion causes shortening of the article of clothing to adapt the article to the wearer.

BRIEF DESCRIPTION OF THE DRAWINGS

The invention will now be described in greater detail with reference to the accompanying drawings, which illustrate preferred embodiments of the invention, and wherein.

DESCRIPTION OF THE PREFERRED EMBODIMENTS

Figure 1:
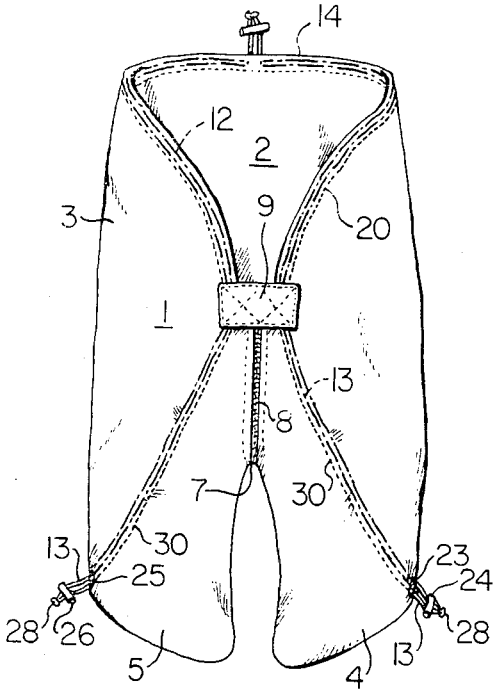
FIG. 1 is a front elevation view of an article of clothing in accordance with the present invention.
Figure 2:
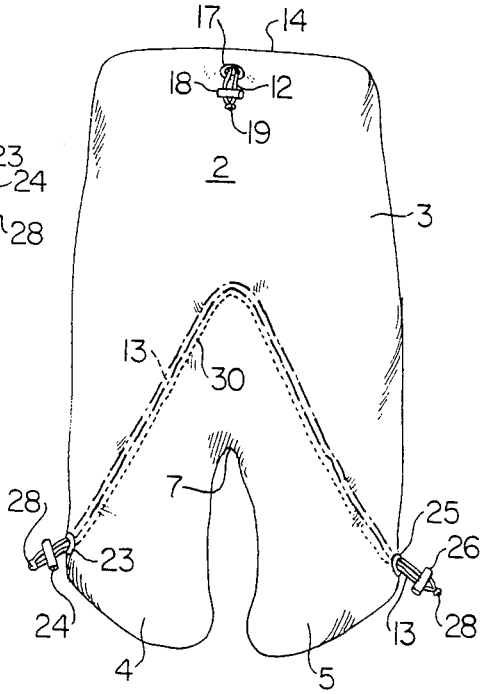
FIG. 2 is a rear elevation view of the article of clothing of FIG. 1.
Figure 3:
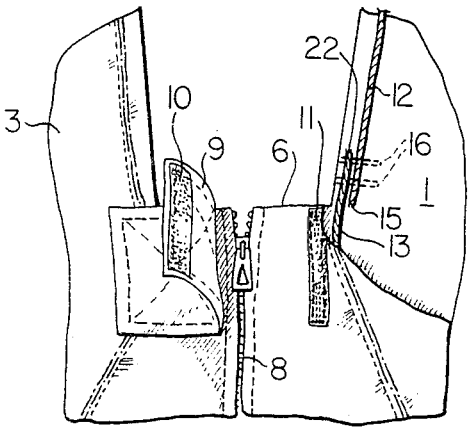
FIG. 3 is a partly sectioned, front view of a portion of the article of clothing of FIGS. 1 and 2.

Referring to FIGS. 1 to 3 of the drawings, an article 5 of clothing in accordance with the present invention includes material defining front and rear panels 1 and 2, respectively. The front and rear panels 1 and 2 can be integral with each other, or alternatively defined by a plurality of pieces of material. The panels define an upper body portion 3 and a pair of legs 4 and 5. The front panel 1 is divided longitudinally from the top edge 6 thereof to the crotch 7 of the garment. A zipper 8 and a tab 9 are provided on the front of the garment for closing the front panel. Opposing Velcro (trademark) strips 10 and 11 are provided on the interior of the tab 9 and on the opposite side of the front panel 1 covering the top end of the zipper 8.

Figure 4:
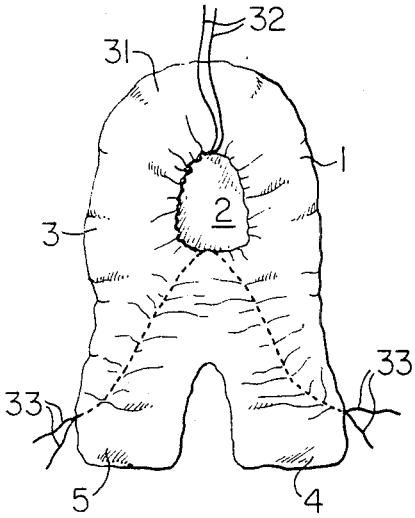
FIG. 4 is a schematic, front view of a second embodiment of the invention in the contracted condition.

A pair of drawstrings 12 and 13 are used to close the open top end 14 of the garment, and to adjust the length of the legs 4 and 5, i.e. to adjust the garment from the expanded condition (FIGS. 1 and 2) to the contracted condition (FIG. 4). The ends 15 (one shown) of the top drawstring 12 are secured between the two layers of the front panel 1 by lines of stitching 16. During manufacture, a loop of the drawstring 12 is pushed out through a grommet 17 at the top rear of the garment, passed through a short peg 18 and knotted at the other end 19, so that the cord cannot slide back through the single opening in the peg 18. By grasping the peg 18 and pushing the material away from the peg, the top opening can be contracted around the head of the user. The cord 12 is retained in position by a line of 5 stitching 20 extending around the open top end 14 beneath the drawstring 12.

The ends 22 (one shown) of the lower drawstring 13 are secured between the layers of the front panel 1 on either side of the centre top edge 6 thereof by the lines of stitching 16. The drawstring 13 extends downwardly from one side of the front panel, out through a grommet 23 and a peg 24, back in through the peg 24 and the grommet 23, up one side of the back panel 3, down the other side of the back panel 3, outwardly through a grommet 25 and a peg 26, back into the peg 26 and the grommet 25 and up the other side of the front panel 1. Knots 28 are formed in the outer ends of the loops, so that the loops in the draw-string 13 cannot slide back through the pegs 24 and 26. The drawstring 13 is maintained in position by lines of stitching 30 between the layers of the front and back panels 1 and 2, respectively. By grasping the peg 24 or 26 and pushing the fabric upwardly along the drawstring 13, the length of the legs 4 and 5 and body of the garment can be shortened. By reversing the process, the legs and body can be lengthened.

The bunting bag of FIG. 4 is slightly different from the garment of FIGS. 1 to 3. The main differences are that the zipper 8 and tab 9 are omitted, and the top end 31 of the garment is intended to extend downwardly around the head of the user. The pegs 18, 24 and 26 are omitted, and the drawstrings 12 and 13 are replaced by separate top drawstrings 32 and two pairs of bottom drawstrings 33. With the garment in any position, the pairs of drawstrings 32 and 33 are tied together to maintain the garment in the desired condition. It will be noted that where possible the same reference numerals have been used to identify elements having counterparts in FIGS. 1 to 3. The same is true in the description of the remaining figures of the drawings.

Figure 5:
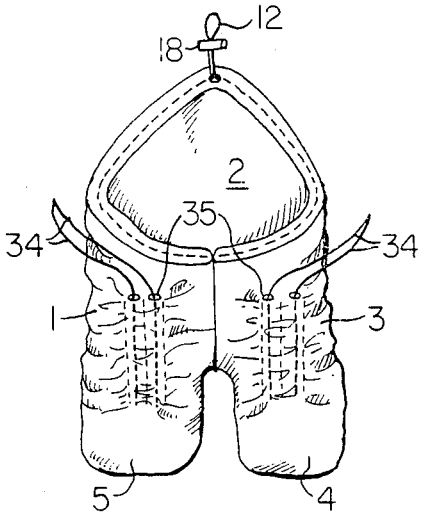
FIG. 5 is a schematic, front elevation view of a third embodiment of the invention in the partially contracted condition.

The embodiment of the invention illustrated in FIG. 5 is similar to that of FIG. 4, except that a pair of drawstrings 34 is provided in the front of each leg 4 and 5. Similar drawstrings (not shown) are provided in the back panel 2 extending through each leg 4 and 5. The drawstrings 34 are secured in the front and rear panels 1 and 2, respectively near the bottom of each leg 4 and 5, and extend upwardly and outwardly through grommets 35 for shortening the legs.

Figure 6:
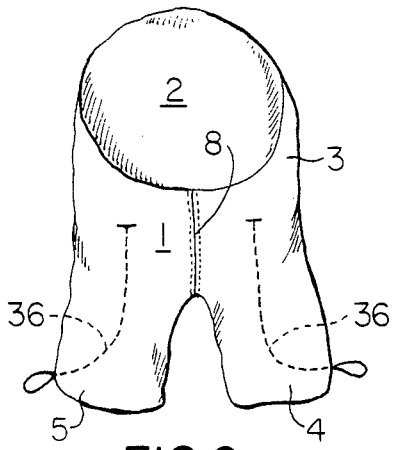
FIGS. 6 and 7 are schematic, front and rear views, respectively of a fourth embodiment of the invention.
Figure 7:
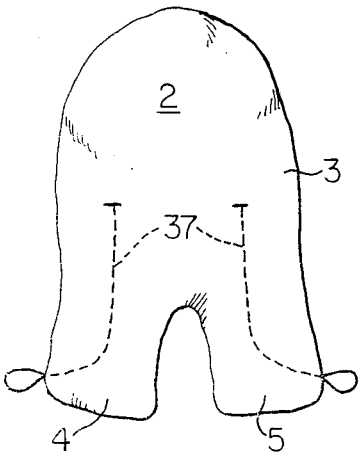

The garment of FIGS. 6 and 7 includes a front central zipper 8, and two pairs of drawstrings 36 and 37 in the front and rear panels 1 and 2, respectively. The top end of each drawstring 36 and 37 is secured in the front or rear panel 1 or 2, and the bottom end of each drawstring extends outwardly from the bottom side edge of the legs 4 and 5. It will be appreciated that a single drawstring can be used on each side of the garment, the drawstring extending downwardly and outwardly in a loop, and then inwardly and upwardly to the other fixed end thereof. The operation or use of the garment of FIGS. 6 and 7 is the same as that of FIG. 1.

Figure 8:
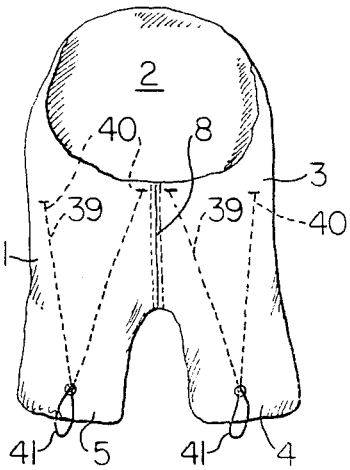
FIG. 8 is a schematic, front view of a fifth embodiment of the invention.

The garment of FIG. 8 is similar to that of FIGS. 6 and 7, except that the drawstrings are replaced by a pair of front drawstrings 39, and a similar pair of rear drawstrings (not shown). The ends 40 of the drawstrings 39 are secured in the body 3 at the tops of the legs 4 and 5. The drawstrings define V's in the legs, with bottom loops 41.

Figure 9:
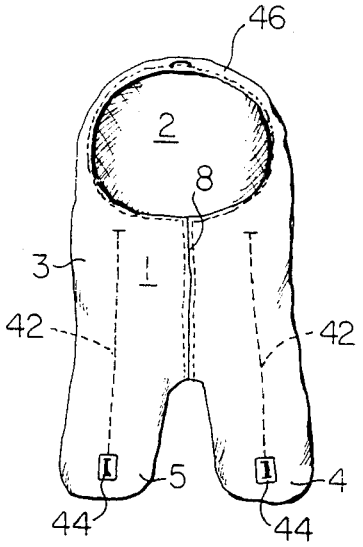
FIG. 9 is a schematic, front view of a sixth embodiment of the invention in the expanded condition.
Figure 10:
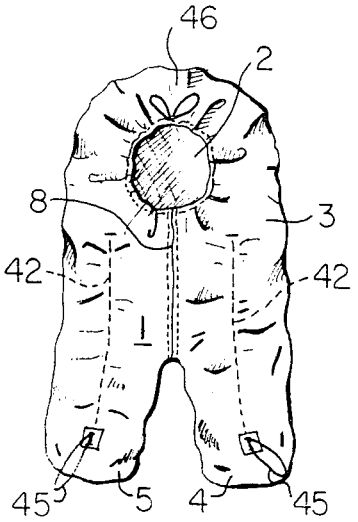
FIG. 10 is a schematic, front view of the article of clothing of FIG. 9 in the contracted condition.

The garment of FIGS. 9 and 10 is a bunting bag including drawstrings 42 in each side of the front thereof, and separate drawstrings (not shown) on each side of the rear thereof. The top ends of the drawstrings are secured in the front and rear panels 1 and 2, respectively, and tabs 44 (FIG. 9) or loops 45 (FIG. 10) are provided at the outer bottom ends thereof for adjusting the length of the legs 4 and 5. The top end 46 of the garment can be left open (FIG. 9) or closed around the head of the user (FIG. 10).

Figure 11:
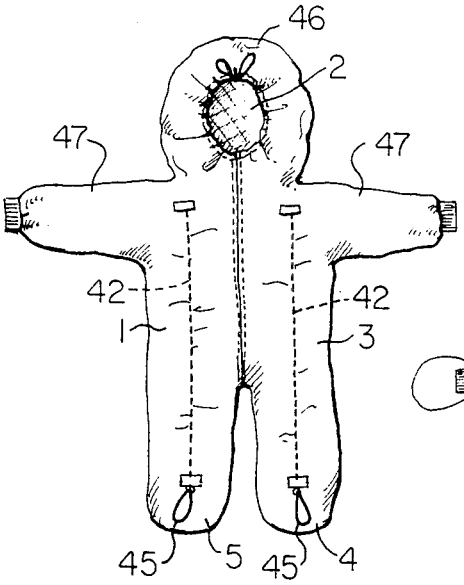
FIG. 11 is a schematic, front view of a seventh embodiment of the invention in the expanded condition.

The garment of FIG. 11 is similar to that of FIG. 10, except that it includes a pair of arms 47.

Figure 12:
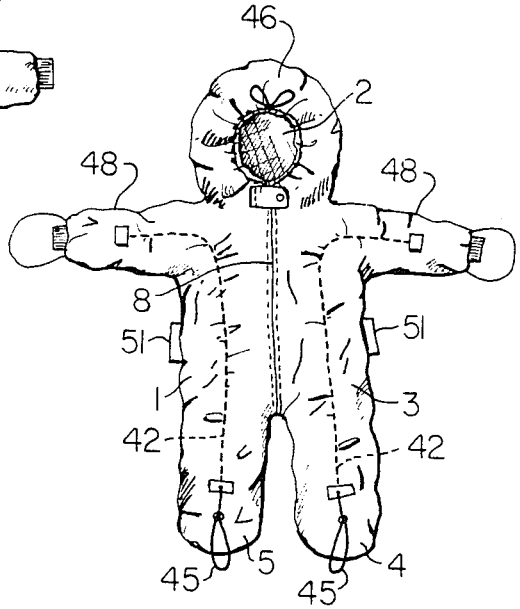
FIG. 12 is a schematic, front view of a eighth embodiment of the invention in the contracted condition.

The garment of FIG. 12 includes a pair of drawstrings, which extend inwardly from the centres of the arms 48 and then downwardly to the bottom of the legs 4 and 5. The top outer ends of the drawstrings are fixed in the sleeves 47, and loops 45 are provided on the bottom ends thereof. Sockets 51 are provided on the sides of the garment for receiving the ends of a carrying strap (not shown), so that a child can be carried using the strap.

It will be appreciated that the legs 4 and 5 need not be closed at the bottom ends. Such legs can be open, so that the garment can be used, for example as a snowsuit with boots or socks. In a simple version, the legs are omitted, i.e. replaced by a leg portion and the garment defines a bunting bag.

What we claim is:

1. An article of children's clothing comprising a front panel and a rear panel connected to said front panel along the sides and bottom thereof for defining a body portion having an open top adapted to encircle an upper portion of the body of the user and a pair of leg portions; first drawstring means secured along at least one of said leg portions and extending along the length of said at least one of said leg portions whereby simultaneous pulling of said first drawstring means and pushing on said leg portion will shorten the length of said leg portion; second drawstring means secured along said body portion and around said open top whereby simultaneous pulling of said second drawstring means and pushing on said body portion reduces the size of said body portion and the size of said open top.

2. An article of clothing according to claim 1, wherein said first drawstring means is secured in the top end of said leg portion and extends along said leg portion and through an opening in the bottom end of said leg portion.

3. An article of clothing according to claim 1, wherein said first drawstring means is secured in the bottom end of the leg portion and extends along said leg portion and through an opening in the top of said leg portion.

4. An article of clothing comprising front panel means; rear panel means connected to said front panel means along the sides and bottom thereof to define a body portion with an open top end and a pair of legs with closed bottom ends; and drawstring means secured along each of the legs and extending through an opening in at least one of said panel means, whereby pulling of the drawstring means while pushing the legs causes shortening of the legs of the article of clothing to adapt the article to the wearer.

5. An article of clothing according to claim 4, wherein said drawstring means is secured to the top of the legs and extends through openings in the bottom ends of the legs.

6. An article of clothing according to claim 4, wherein said drawstring means is secured to the bottom ends of the legs and extends through openings in the top ends of said legs.

7. An article of clothing according to claim 4, wherein said drawstring means comprises a cord secured along both of said legs, and passing through an opening in at least one of said panel means at a location between said ends of the legs.

8. An article of clothing according to claim 4, including a first drawstring in said legs, and a second drawstring extending around the top end of the article of clothing for tightening said top end around the head of a user.

9. An article of clothing according to claim 5, including a first drawstring in said legs, and a second drawstring extending around the top end of the article of clothing for tightening said top end around the head of a user.

10. An article of clothing according to claim 6, including a first drawstring in said legs, and a second drawstring extending around the top end of the article of clothing for tightening said top end around the head of a user.

11. An article of clothing according to claim 4 including a first drawstring, the ends of which are secured in said front panel means on each side of the top centre thereof, said first drawstring extending downwardly and outwardly in one side of said front panel, out of the article to define a first exterior loop at the one bottom corner of the article, upwardly and inwardly in said rear panel means, then downwardly and outwardly in said rear panel means, out of the article to define a second exterior loop at the other bottom corner of the article, and upwardly and inwardly in the other side of said front panel.

12. An article of clothing according to claim 11, including a second drawstring extending around the inner top end of the article for tightening said top end around the head of a user.

13. An article of clothing according to claim 4, including a pair of arms defined by said front and rear panel means, said drawstring means including a drawstring on each side of the centre of said front panel, one end of each drawstring being fixed in one arm, the drawstring extending inwardly and downwardly in said front panel, and outwardly for grasping.

14. An article of clothing according to claim 4, including a pair of arms defined by said front and rear panel means, said drawstring means including a drawstring on each side of the centre of said front panel, one end of each drawstring being fixed in one arm, the drawstring extending inwardly and downwardly in said front panel, and outwardly for grasping

* * * * *